United States Patent [19]

Tarpley, Jr.

[11] 4,156,593

[45] May 29, 1979

[54] ULTRASONIC WET GRINDING COAL

[75] Inventor: William B. Tarpley, Jr., West Chester, Pa.

[73] Assignee: Energy and Minerals Research Co., Kennett Square, Pa.

[21] Appl. No.: 839,231

[22] Filed: Oct. 4, 1977

[51] Int. Cl.[2] ..... C10L 9/10; B02C 23/36

[52] U.S. Cl. ..... 44/1 R; 241/20

[58] Field of Search ..... 44/1 R, 2; 208/8; 241/20

[56] References Cited

U.S. PATENT DOCUMENTS 2,722,498 11/1955 Morrell et al. ..... 208/8

*Primary Examiner*—Carl Dees

*Attorney, Agent, or Firm*—Seidel, Gonda, Goldhammer & Paniteb

[57] ABSTRACT

A slurry of coal and a liquid which includes a leaching agent is directed through a chamber. The coal particles are comminuted and cavitation is induced in said slurry while the slurry is in the chamber by contact in the slurry with a resonant vibration transmitting member. Thereafter, the liquid is separated from the comminuted particles.

8 Claims, 5 Drawing Figures

FIG. 1
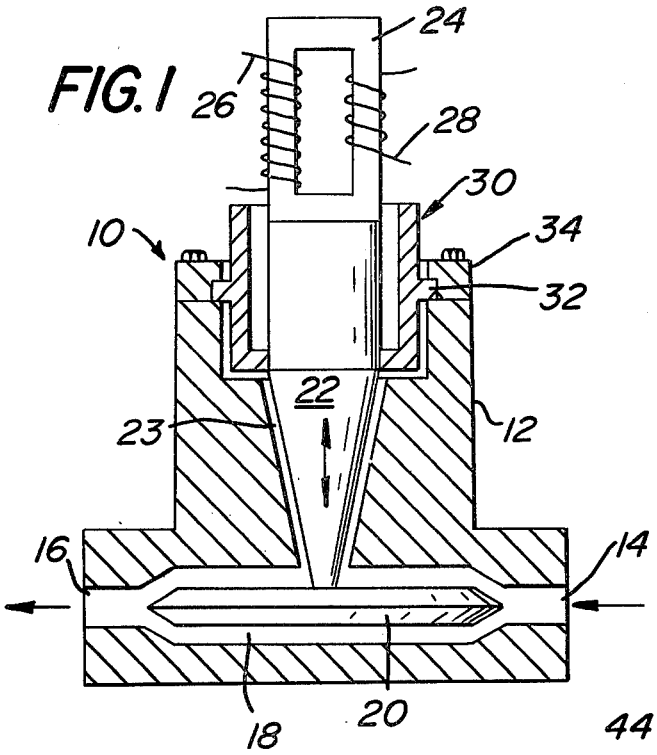
FIG. 2
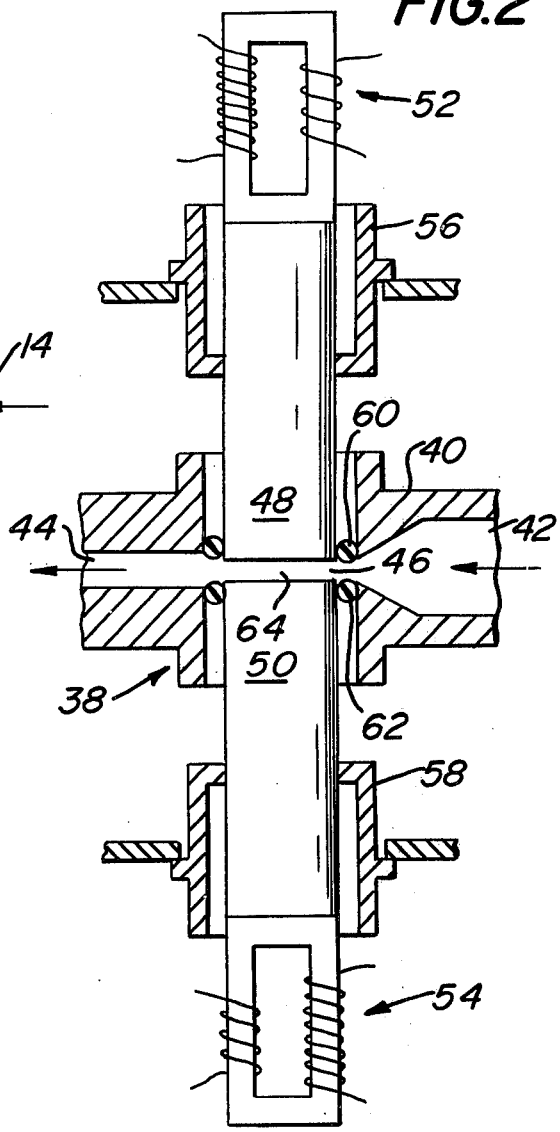
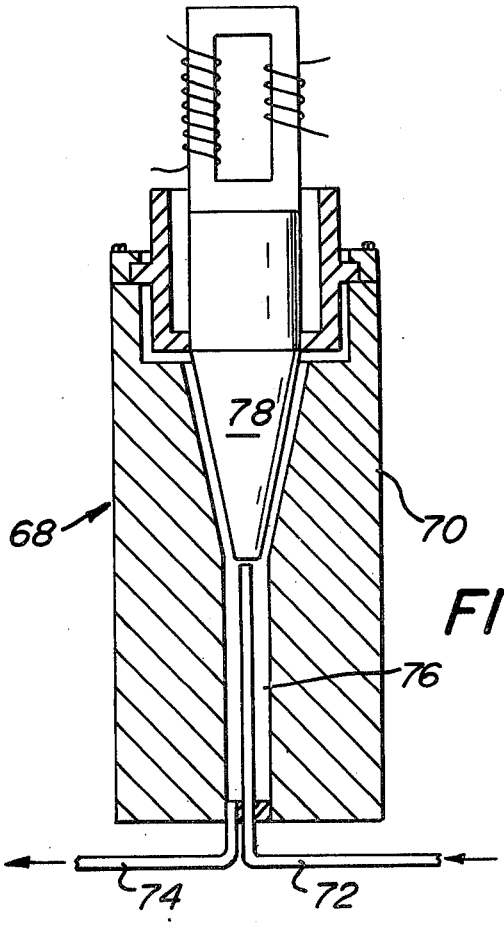
FIG. 3

ULTRASONIC WET GRINDING COAL

BACKGROUND

Coal has a number of contaminants which interfere with desired methods of consumption of the coal and/or create pollutants. Typical contaminants are pyrites, clay, etc. Removal of the contaminants is difficult and expensive in some grades of the coal where the contaminants are fine and distributed throughout the coal. Processes utilized heretofore are slow and require elevated temperatures and pressures.

The present invention reduces the temperatures or pressures required while increasing the throughput rate thereby increasing overall efficiency by using ultrasonics. For prior art dealing with treatment of fluids by ultrasonics, see U.S. Pat. Nos. 2,722,498; 3,614,069 and Re 29,161.

SUMMARY OF THE INVENTION

Solid particles of coal to be comminuted are mixed with a liquid to thereby form a slurry. The slurry is directed through a chamber. The particles are comminuted and cavitation is induced in the slurry while the slurry is moving through the chamber by contacting the slurry with a resonant vibration transmitting member. Thereafter, the liquid is separated from the comminuted particles. If the coal contains undesirable contaminants, they may be extracted by adding a leaching agent to the slurry.

It is object of the present invention to provide novel apparatus and method for ultrasonic wet grinding of coal and similar products.

It is another object of the present invention to provide novel method and apparatus for treating coal to remove contaminants in a manner which increases the throughput efficiency while avoiding the necessity for high pressures and temperatures.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a sectional view through apparatus in accordance with the present invention.

FIG. 2 is a sectional view through another embodiment of apparatus in accordance with the present invention.

FIG. 3 is a sectional view through apparatus in accordance with another embodiment of the present invention.

Referring to the drawings in detail, wherein like numerals indicate like elements, there is shown in FIG. 1 apparatus in accordance with one embodiment of the present invention designated generally as 10.

Figure 4:
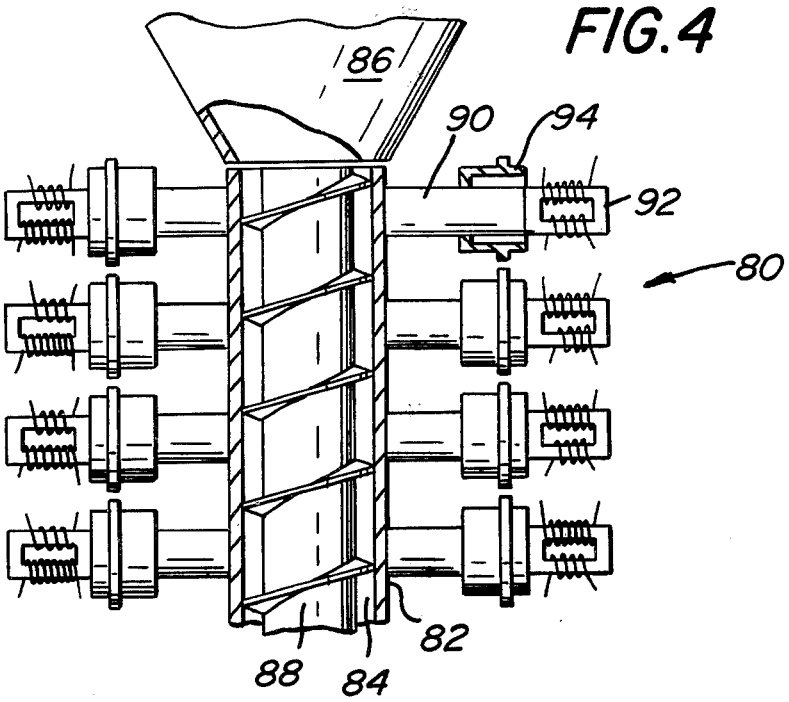
FIG. 4 is a sectional view through apparatus in accordance with another embodiment of the present invention.

The apparatus 10 includes a housing 12 preferably made of a plurality of components bolted together, and without illustrating the parting line of such components. Housing 12 is made from any suitable non-corrodable material such as plastic, ceramic, and metal such as stainless steel. Housing 12 has an inlet passage 14 and an outlet passage 16 communicating with an elongated chamber 18. An enlongated disk 20 resonant in a flexural mode and having an antinode at a sharp peripheral edge is supported within the chamber 18 spaced from the walls defining the chamber 18. The length of the disk 20 is preferably substantially equal to the length of the chamber 18. At an antinode, the center of disk 20 is metallurgically bonded, such as by welding, to one end of a vibration-transmitting member 22 with a good impedance match. The presence of an antinode at the center and periphery of disk 20 accentuates the extent of vibratory energy transmitted to the slurry. The member 22 is made of metal, is preferably resonant in a longitudinal mode, and preferably has a tapered surface exposed to chamber 18 as shown. The end of member 22, remote from the disk 20, is fixedly secured to a transducer 24 with a good impedance match such as by welding or brazing.

The transducer 24 may comprise a laminated core of nickel or other magnetostrictive material having a rectangularly shaped opening therein. A polarizing coil 28 is wound through the opening on one side thereof and an excitation coil 26 is wound through the opening on the opposite side thereof. Upon variation of the magnetic field strength of the excitation coil 26, there will be produced concomitant variants in the dimensions of the transducer 24, provided that the polarizing coil 28 is charged to a suitable level with DC current, and that the frequency of the aforesaid variations will be equal to the frequency of the alternating electric current flowing in coil 26. Other types of transducers may be used in place of magnetostrictive transducers, such as electrostrictive ceramic wafers which are commercially available.

Member 24 is preferably provided with a force-insensitive mount 30. The mount 30 facilitates supporting the source of vibratory energy on the housing 12 with little or no loss of vibratory energy into the housing 12.

Per se, a force-insensitive mount is known. For example, see U.S. Pat. No. 2,891,178. A force-insensitive mount is a resonant member having a length equivalent to an even multiple of one-quarter wave lengths of the material of which it is made at the frequency of operation of the source to which it is attached. One end of the mount 30 is fixedly secured to member 22 at an antinode thereon with the other end being free from attachment. At an odd multiple of the equivalent of one-quarter wave length of the frequency of operation, the mount has a flange 32 extending radially outwardly. The flange 32 is supported by the housing 12 and clamped by a ring 34 which can be bolted to the housing 12 to form a seal.

The most common contaminants of coal which are desired to be removed from the coal are pyrites and clay. A liquid is added to coal to form a slurry which is then pumped through inlet passage 14, through chamber 18, and exits from passage 16 onto a separting screen or the like wherein the liquid will be separated from the coal. As the slurry is passing through the chamber 18, the vibration of the disk 20 mechanically comminutes the coal. In addition, the vibration of disk 20 creates cavitation in the slurry which further comminutes the coal. As is well known, ultrasonic cavitation creates bubbles at the coal-liquid interface which implode. The dual action of mechanical contact with the disk 20 and the cavitation in the slurry comminutes the coal and also exposes any finely divided contaminants for removal.

The vibratory power needed must be in excess of that required to induce cavitation in the slurry and varies with the liquid involved, the frequency of vibration, and the temperature of the liquid. The threshold power needed to induce cavitation in water at room temperature is between 0.2 and 2 watts/cm$^2$ with a frequency of vibration between 1,000 and 100,000 cps. The cavitation scrubs the surface of the coal to break up surface film, the impact of the bubbles fragments the surface of the coal, and increases the rate of diffusion of the liquid into and out of the coal. Such fragmentation and diffusion is facilitated by the fact that coal is very porous. Preheating of the slurry is not required except where a leaching agent is included. Some leaching agents are more effective at temperatures up to about 60° C.

The liquid used to form the slurry with coal is preferably an aqueous liquid which may include one or more of a leaching agent and a penetrant for inducing fracture of the coal. Typical penetrants which may be used include ammonia and methanol, tetralin, o-cyclohexyl phenol, ethanolamine, pyridine, acrylonitrile, liquid sulfur dioxide, and surfactants. Such liquids penetrate into the coal and augment fracture of the coal, and may be referred to as embrittling agents.

A wide variety of leaching agents may be added to the liquid forming the slurry with the coal. Typical leaching agents include aqueous ferric sulfate, alkali metal hydroxide such as sodium hydroxide or potassium hydroxide, ferrous sulfate, ferric chloride, etc.

The embrittling agent renders the coal more susceptible to communition. The leaching agent removes the contaminants from the coal. If desired, the slurry may include a surfactant, grinding aid or separating aide such as Cabosil, sodium silico aluminate, and the like which prevent the coal particles from reaglomerating. Separation of the liquid from the coal particles after the slurry exits from passage 16 may be accomplished by any one of a wide variety of conventional separating means including screens, flotations tanks, and the like. High production rates are achieved due to the continuous flow of slurry through the chamber 18. A suitable slurry may be made by mixing the following with the portions being designations by weight: coal—1% to 70% with size from powder to ¼ inch; liquid—remainder; if a leaching agent is present, it should be able to reduce pyrites from about 3% to about 0.7%.

The transducer 24 preferably operates in a frequency range of 1000 Hertz to 20,000 Hertz. It is preferable to have a source of energy which is in the ultrasonic range since the frequency of vibration is above the audible range which is generally considered to be 14,000 Hertz.

In FIG. 2, there is illustrated another embodiment of the present invention wherein the apparatus is designated generally as 38. Apparatus 38 includes a housing 40 having an inlet passage 42, an outlet passage 44, each communicating with a chamber 46. Chamber 46 is preferably cylindrical. First and second vibration-transmitting members 48 and 50 enter the chamber 46 with their free end being an antinode. Members 48 and 50 are resonant in a longitudinal mode and otherwise are the same as member 22 except for the fact that they are not tapered at their free end which are antinodes. The members 48, 50 are spaced from one another by a gap 64 which may be varied from ⅛ inch to 4 inch.

Member 48 is provided with a source of vibratory energy 52 corresponding to the source shown in FIG. 1 and has a force-insensitive mount 56 corresponding to the mount 30. Member 50 has a similar source of vibratory energy 54 and a force-insensitive mount 58. The members 48 and 50 are preferably 180° out of phase so that the field in gap 64 is alternatively compressed and expanded to the point of cavitation. A seal 60 is provided between housing 40 and member 48. A similar seal 62 is provided between housing 40 and member 50. The seals may be O rings of a polymeric plastic material. If desired, the mounts 56, 58 may be sealed to housing 40 thereby eliminating seals 60, 62. Housing 40 is preferably made from the materials set forth above. Apparatus 38 operates in the same manner as described above in connection with apparatus 10.

In FIG. 3, there is illustrated another embodiment of the apparatus of the present invention designated generally as 68. Apparatus 68 is the same as apparatus 10 except as will be made clear hereinafter. In apparatus 68, the housing 70 is provided with an inlet passage 72 and an outlet passage 74 each of which communicate with the chamber 76. The vibration-transmitting member 78 terminates in a free end face having an antinode spaced from and closely adjacent to the discharge point of the slurry from passage 72.

Referring to FIG. 4, there is illustrated another embodiment of the present invention designated generally as 80. The apparatus 80 includes a housing 82 which is resonant in a radial mode and having a chamber 84 therein. In chamber 84, there is provided a shaft 88 having a helical screw flight to develop macro-mixing. A slurry is introduced into the housing 82 by way of a hopper or supply vessel 86.

The housing 82 is provided with a plurality of sources of vibratory energy extending radially outwardly therefrom and which are tuned to drive housing 82 in a radial mode. Each source includes a vibration-transmitting member 90 having one end connected to housing 82 with a good impedance match and having its other end connected to a transducer 92. Each member 90 is provided with a force-insensitive mount 94. Each of the mounts 94 are supported by a stationary frame not shown. As the slurry flows downwardly through chamber 84, it is subjected to mechanical forces by the screw flight on shaft 88 and cavitation is induced into the slurry by the resonant vibrations of housing 82. The shaft 88 avoids an inactive region of vibration energy from developing in the center of chamber 84. Shaft 88 may be stationary but preferably is rotated slowly about its longitudinal axis by a motor not shown. If desired, shaft 88 may be resonant and vibrated in a radial mode.

Figure 5:
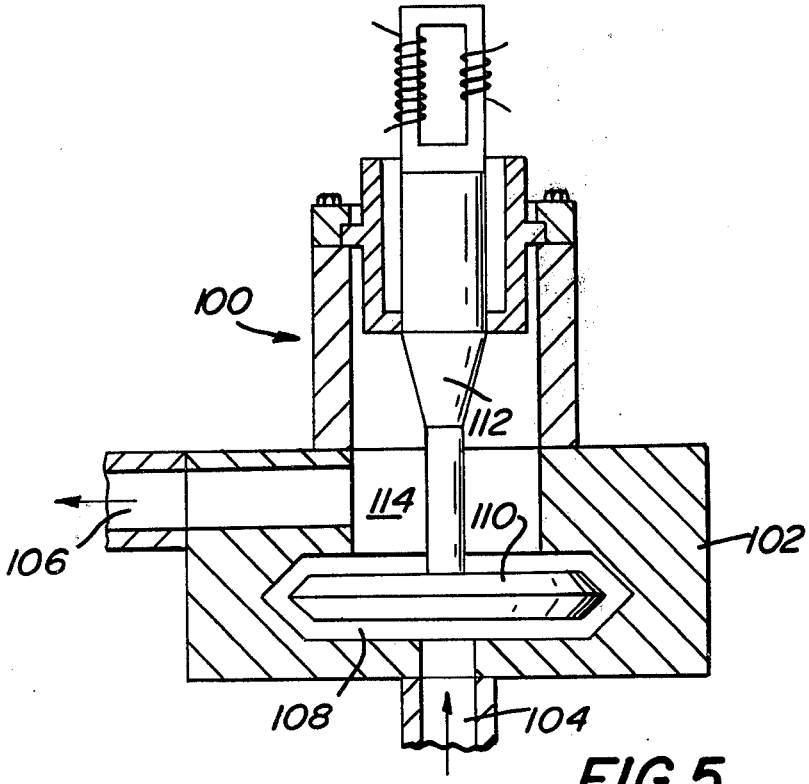
FIG. 5 is a sectional view through apparatus in accordance with another embodiment of the present invention.

In FIG. 5, there is illustrated apparatus 100 in accordance with another embodiment which is identical with apparatus 10 except as set forth hereinafter. The apparatus 100 includes a housing 102 preferably made of a plurality of components bolted together, and without illustrating the parting line of such components. Housing 102 is made from any suitable non-corrodable material such as plastic, ceramic, and metal such as stainless steel. Housing 102 has an inlet passage 104 and an outlet passage 106 communicating with a circular chamber 108. A circular disk 110 resonant in a flexural mode and having an antinode at a sharp peripheral edge is supported within the chamber 108 spaced from the walls defining the chamber 108.

The diameter of the disk 110 is preferably substantially equal to the diameter of the chamber 108. At an antinode, the center of disk 110 is metallurgically bonded, such as by welding, to one end of a vibration-transmitting member 112 with a good impedance match. The presence of an antinode at the center and periphery of disk 110 accentuates the extent of vibratory energy transmitted to the slurry. The member 112 is made of metal, is preferably resonant in a longitudinal mode, and preferably is tapered as shown. A chamber 114 communicates chamber 108 with outlet passage 106. Member 112 extends through the chamber, is coaxial therewith, and has an antinode exposed to the slurry in chamber 114. Slurry must flow from inlet passage 104, through chamber 108, around disk 110 to chamber 114, and then to outlet passage 106.

Each of the embodiments described above is structurally interrelated so that the slurry cannot avoid the active area of vibratory energy. In each embodiment, the slurry is exposed to a large surface area of the vibratory member as compared with the area of the chamber through which the slurry can flow. For example, the exposed surface area of members 22 and 78 greatly exceeds the cross-sectional areas of said members and also exceeds the cross-sectional area of the chamber through which the slurry can flow. Also, in each embodiment, there are successive or progressive regions of vibratory energy with which the slurry comes into contact.

The present invention may be embodied in other specific forms without departing from the spirit or essential attributes thereof and, accordingly, reference should be made to the appended claims, rather than to the foregoing specification as indicating the scope of the invention.

I claim:

1. A method of comminuting solid particles comprising:

(a) forming a slurry of solid particles and a liquid,
(b) directing the slurry through a chamber,
(c) comminuting said particles and inducing cavitation in said slurry while said slurry is moving through said chamber by contacting said slurry with a resonant vibration transmitting member, and
(d) positioning said member in said chamber so that there are no inactive regions of vibratory energy through which the slurry can flow,
(e) supporting said member by a mount which minimizes loss of vibratory energy to the support,
(f) separating the liquid from the comminuted particles.

2. A method in accordance with claim 1 comprising:

(a) forming said slurry from coal which constitutes the solid particles and wherein the liquid contains a leaching agent capable of extracting contaminants from the coal,
(b) separating the contaminants from the coal by said leaching agent as a result of exposing the contaminants by said comminuting step.

3. A method in accordance with claim 2 including providing the liquid with an embrittling agent.

4. A method in accordance with claim 1 wherein said resonant vibration-transmitting member is resonant in a longitudinal mode and has at least one antinode at a surface exposed within said chamber, contacting the slurry with said surface.

5. A method in accordance with claim 1 including using said vibration-transmitting member with a disk resonant in a flexural mode with an antinode at its periphery.

6. A method in accordance with claim 1 including using said resonant vibration-transmitting member with a hollow housing resonant in a radial mode.

7. A method of comminuting solid particles comprising:

(a) forming a slurry of coal containing contaminants in the form of pyrites with a liquid containing a leaching agent capable of extracting said contaminants,
(b) pumping a slurry through a chamber having an inlet spaced from an outlet,
(c) comminuting said coal and inducing cavitation in said slurry while said slurry is moving through said chamber by contacting said slurry with a resonant vibration-transmitting member thereby exposing said contaminants,
(d) positioning said member in said chamber so that there are no inactive regions of vibratory energy through which the slurry can flow,
(e) supporting said member by a mount which minimizes loss of vibratory energy to the support,
(f) extracting the contaminants by said leaching agent, and
(g) separating the liquid from the comminuted coal particles.

8. A method in accordance with claim 7 including using a liquid embrittling agent in said slurry.

* * * * *